US005217361A

United States Patent [19]

Fujiwara et al.

[11] Patent Number: 5,217,361

[45] Date of Patent: Jun. 8, 1993

[54] FLUID COMPRESSOR HAVING LUBRICATION FOR TWO SPIRAL BLADE COMPRESSION SECTIONS

[75] Inventors: Takayoshi Fujiwara, Kawasaki; Moriaki Shimoda; Yoshinori Sone, both of Yokohama; Noritsugu Kawashima, Tokyo; Kazuhisa Sumida, Yokohama, all of Japan

[73] Assignee: Kabushiki Kaisha Toshiba, Kawasaki, Japan

[21] Appl. No.: 826,970

[22] Filed: Jan. 28, 1992

[30] Foreign Application Priority Data

Mar. 8, 1991 [JP] Japan ..... 3-43649

[51] Int. Cl.[5] ..... F04C 18/107; F04C 29/02

[52] U.S. Cl. ..... 418/76; 418/91; 418/99; 418/188; 418/220

[58] Field of Search ..... 418/76, 77, 79, 91, 418/97-99, 188, 220

[56] References Cited

U.S. PATENT DOCUMENTS

| | | | |
|---|---|---|---|
| 4,402,653 | 9/1983 | Maruyama et al. | 418/79 |
| 4,871,304 | 10/1989 | Iida et al. | 418/220 |
| 4,872,820 | 10/1989 | Iida et al. | 418/220 |
| 5,026,264 | 6/1991 | Morozumi et al. | 418/220 |
| 5,090,874 | 2/1992 | Aikawa et al. | 418/220 |

FOREIGN PATENT DOCUMENTS

| | | | |
|---|---|---|---|
| 56-148696 | 11/1981 | Japan | 418/76 |
| 2-19684 | 1/1990 | Japan . | |
| 2-201077 | 8/1990 | Japan | 418/220 |
| 2-201082 | 8/1990 | Japan | 418/220 |
| 2-201092 | 8/1990 | Japan | 418/220 |

*Primary Examiner*—John J. Vrablik

*Attorney, Agent, or Firm*—Cushman, Darby & Cushman

[57] ABSTRACT

A compressor includes a casing having an oil reservoir, a cylinder situated within the casing, a cylindrical rotary body situated eccentrically within the cylinder, the rotary body having first and second spiral grooves extending in opposite directions from the middle part of the rotary body to both ends of the rotary body, first and second spiral blades fitted in the first and second spiral grooves, the blades having outer peripheral surfaces brought into contact with the inner peripheral surface of the cylinder, dividing the space defined by the inner peripheral surface of the cylinder and the rotary body into a plurality of working chambers, thereby constituting first and second compression sections, wherein the first and second blades freely project from and retreat in the first and second spiral grooves in the radial direction of the rotary body, driving means for rotating the cylinder and the rotary body relative to each other, a first refrigerant passage formed in the rotary body and opening to an area between the first and second compression sections and to one axial end portion of the rotary body, and oil supply means having first and second oil supply holes opening respectively to the first and second compression sections, and supplying oil in the oil reservoir to the first and second compression sections via the first and second oil supply holes.

4 Claims, 6 Drawing Sheets

FLUID COMPRESSOR HAVING LUBRICATION FOR TWO SPIRAL BLADE COMPRESSION SECTIONS

BACKGROUND OF THE INVENTION

1. Field of the Invention

The present invention relates generally to a fluid compressor and more particularly to a fluid compressor for compressing a refrigerant in a refrigerating cycle.

2. Description of the Related Art

Conventionally, a fluid compressor for compressing, for example, a refrigerant gas in a refrigerating cycle has been developed. This fluid compressor, as compared to a reciprocal type compressor or a rotary type compressor etc., comprises a less number of parts and a simpler driving mechanism. In addition, in this fluid compressor, a check valve is dispensed with and the compression efficiency is enhanced.

In the compressor of this type, a rotary body or a piston is eccentrically situated within a cylinder having both end portions opened. Both end portions of the piston are journaled in a main bearing or a suction-side bearing, and a sub-bearing or a discharge-side bearing. The piston is eccentrical to the cylinder.

The main bearing and sub-bearing are inserted in both end portions of the cylinder, such that the bearings hermetically seal the openings at both end portions of the cylinder. A spiral groove is formed in the outer peripheral surface of the piston, and a blade is wound along the spiral groove so that the blade can freely project from and retreat in the groove.

The inside space in the cylinder is divided by the blade into a plurality of working chambers. The volumes of the working chambers are gradually decreased from the suction side of the cylinder towards the discharge side.

A motor unit is provided on the peripheral wall of the cylinder. When the motor unit is actuated and the cylinder is rotated, the cylinder and piston are rotated relative to each other and synchronously by means of a torque transmission mechanism interposed between the cylinder and piston.

Thereby, a low-pressure refrigerant gas is introduced into a sealed casing through a suction pipe connected to the sealed casing. The refrigerant gas is gradually compressed while it is conveyed from the working chamber at the suction-side end of the cylinder towards the chamber at the discharge-side end. When the refrigerant gas is discharged from the discharge-side end, it has a high pressure of a predetermined value. The high-pressure gas is supplied to a condenser through a discharge pipe connected to the cylinder. The condenser is situated outside the compressor and it is a component of the refrigerating cycle.

A modification of this compressor is disclosed, for example, in Published Unexamined Japanese Patent Application 2-19684 filed by the applicant of the present application.

In this compressor, a pair of spiral grooves are formed in the peripheral surface of the piston. These spiral grooves are formed symmetrical from an axially middle part of the piston towards both ends of the piston. Spiral blades are fitted in the respective spiral grooves.

A low-pressure refrigerant gas is sucked from, for example, an axially middle part of the cylinder. The gas is conveyed in two directions, i.e. towards both end portions of the cylinder, and compressed and then discharged from both end portions of the cylinder.

In the above-described compressor with on spiral groove in the piston, a lubricating oil is supplied to sliding parts of the compressor. The sliding parts include sliding surfaces defined by the side wall of the spiral groove and the side surface of the blade, sliding surfaces defined by the main bearing, cylinder and piston, and sliding surfaces defined by the sub-bearing, cylinder and piston.

Of course, the above-described compressor with a pair of spiral grooves and a pair of blades has sliding parts. Accordingly, oil supply means is required for supplying a lubricating oil to the sliding parts.

In this type of compressor, however, an optimal oil supply mechanism has not yet developed. Under the situation, oil supply means employed in the compressor with one spiral groove in the piston has been adopted in the compressor with two grooves and blades.

Because of this, while the sliding parts of one of the compression section (e.g. sliding surfaces between one spiral groove and the corresponding blade) is sufficiently supplied with oil, the sliding parts of the other compressing section is not. The resultant bad sealing property causes lowering of compression performance or increase of input.

The present invention was made in consideration of the above circumstances, and its object is to provide a fluid compressor having a pair of spiral grooves and a pair of blades, wherein the respective sliding parts are surely supplied with oil and smoothness of the sliding parts is ensured for long time.

SUMMARY OF THE INVENTION

The above object of the invention can be achieved by providing a casing having an oil reservoir, a cylinder situated within the casing, a cylindrical rotary body situated eccentrically within the cylinder and supported with part thereof brought into contact with the inner peripheral surface of the cylinder, the rotary body having, in its outer peripheral surface, first and second spiral grooves extending in opposite directions from the middle part of the rotary body to both ends of the rotary body, first and second spiral blades fitted in the first and second spiral grooves, the blades having outer peripheral surfaces brought into contact with the inner peripheral surface of the cylinder, dividing the space defined by the inner peripheral surface of the cylinder and the rotary body into a plurality of working chambers, thereby constituting first and second compression sections, wherein the first and second blades freely project from and retreat in the first and second spiral grooves in the radial direction of the rotary body, driving means for rotating the cylinder and the rotary body relative to each other, a first refrigerant passage formed in the rotary body and opening to an area between the first and second compression sections and to one axial end portion of the rotary body, and oil supply means having first and second oil supply holes opening respectively to the first and second compression sections, and supplying oil in the oil reservoir to the first and second compression sections via the first and second oil supply holes.

With this structure, the oil supply means can supply a sufficient amount of oil to the sliding parts, and smoothness of the sliding parts is ensured for a long time.

DETAILED DESCRIPTION OF THE PREFERRED EMBODIMENTS

Embodiments of the present invention as applied to a fluid compressor (hereinafter, referred to as "compressor") employed, for example, in a refrigerating cycle will now be described with reference to the accompanying drawings.

Figure 1:
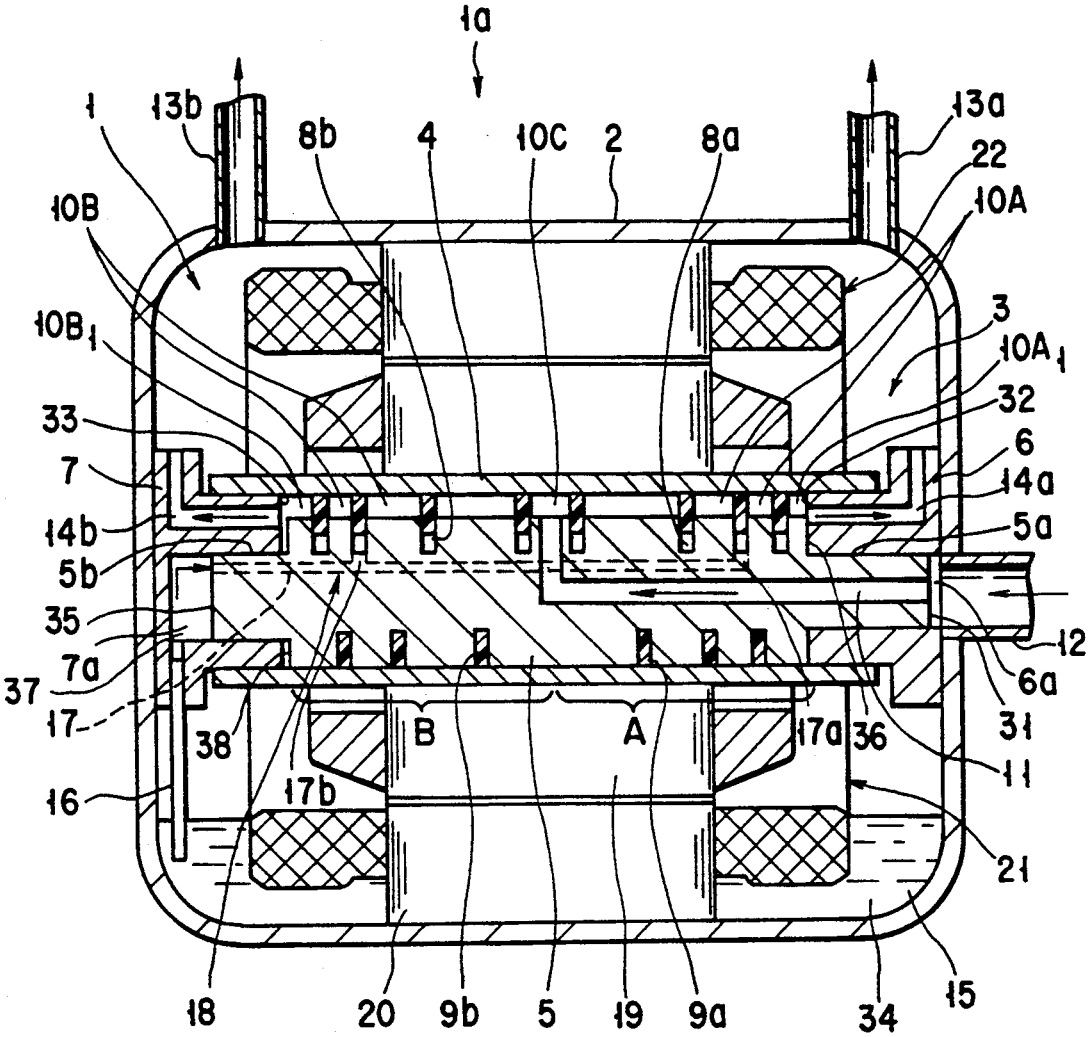
FIG. 1 is a vertical cross-sectional view showing a first embodiment of the present invention.

FIG. 1 shows a compressor 1*a* according to a first embodiment of the invention. A compressor body 1 has a sealed casing 2 and a compressor mechanism 3 contained within the casing 2. The compressor mechanism 3 comprises a cylinder 4 having both axial end portions opened, and a piston 5 or a rotary body situated eccentrically within the cylinder 4.

Both end portions of the piston 5 are inserted into support holes 6*a* and 7*a* of a main bearing 6 and a sub-bearing 7, and the piston 5 is rotatably supported. The support holes 6*a* and 7*a* are eccentrially formed relative to each outer peripheral surface of the main bearing 6 and sub-bearing 7.

Specifically, both axial end portions of the piston 5 are provided with a main shaft portion and a sub-shaft portion, which are relatively thinner than the other portion thereof. The main shaft portion 5*a* is inserted into the main bearing 6, and the sub-shaft portion 5*b* into the sub-bearing 7.

The main bearing 6 and sub-bearing 7 are inserted in openings at both end portions of the cylinder 4, such that the outer peripheral surfaces of the bearings 6 and 7 are brought into contact with the inner peripheral surfaces of the cylinder 4 thereby hermetically sealing both openings of the cylinder 4. The main bearing 6 and sub-bearing 7 are fixed to the inner wall of the sealed casing 2.

Figure 2:
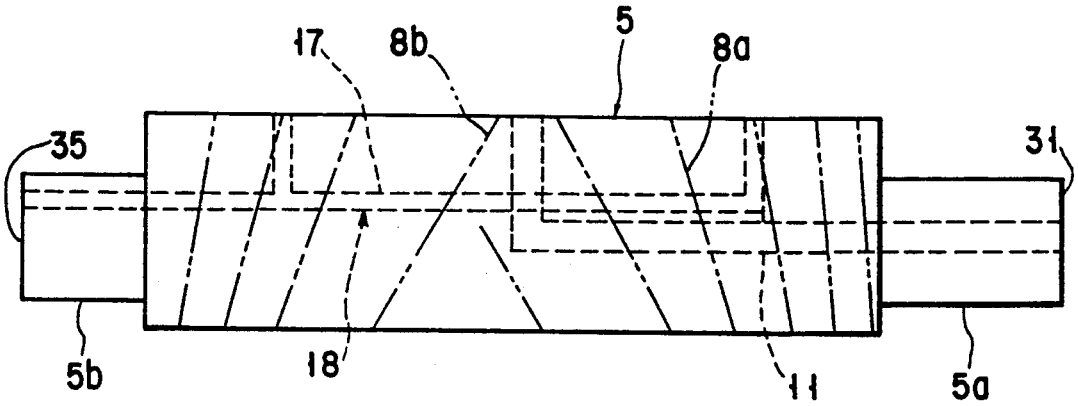
FIG. 2 is a view for illustrating a rotary body according to the first embodiment.

First and second spiral grooves 8*a* and 8*b* are formed in the outer peripheral surface of the piston, as shown in FIG. 2. The spiral grooves 8*a* and 8*b* extend from the axially middle portion of the piston 5 towards both end portions thereof, and the grooves 8*a* and 8*b* are symmetrical with each other.

The width of each of the first and second spiral grooves 8*a* and 8*b* is constant. The depth direction of each groove 8*a*, 8*b* coincides with the radial direction of the piston 5. The grooves 8*a* and 8*b* are wound in opposite directions.

The pitches of the spiral groove 8*a* and 8*b* are decreased gradually from the axially middle portion of piston 5 towards both end portions of piston 5. In addition, the phases of the first and second spiral grooves 8*a* and 8*b* are displaced from each other by 180°.

As is shown in FIG. 1, first and second spiral blades 9*a* and 9*b* are provided within the cylinder 4. The blades 9*a* and 9*b* are made of, for example, Teflon (Trademark) resin and have suitable elasticity. The blades 9*a* and 9*b* are fitted in the grooves 8*a* and 8*b* so that the blades 9*a* and 9*b* can freely project from and retreat in the grooves 8*a* and 8*b*. The blades 9*a* and 9*b* are wound around the piston 5 so that they can freely project from and retreat in the piston 5. The outer peripheral surfaces of the blades 9*a* and 9*b* are brought into contact with the inner peripheral surface of the cylinder 4.

The inside space of the cylinder 4 is divided by the blades 9*a* and 9*b* into a plurality of crescent working chambers 10A and 10B. The working chambers 10A and 10B are arranged along the axis of the piston 5. The volumes of the working chambers 10A and 10B are decreased gradually from the axially middle portion of the piston 5 towards both ends thereof.

As is shown in FIGS. 1 and 2, a suction passage 11 is formed within the piston 5. The suction passage 11 is open to an end face 31 of the main bearing 6. The passage 11 extends from the end face 31 along the axis of the piston 5 to the axially middle portion of the piston, and is bent in the radial direction at the axially middle portion to be open to the outer peripheral surface of the piston 5.

A suction pipe 12 is connected to one side surface of the sealed casing 2. The suction pipe 12 communicates with an external device or an evaporator (not shown). The open end face of the suction pipe 12 communicates with the support hole 6*a* of the main bearing 6 and also communicates with the suction passage 11 by making use of the space of the support hole 6*a*.

On the other hand, first and second exhaust pipes 13*a* and 13*b* are connected to both axial end portions of the sealed casing 2 (i.e. both end portions of the upper part in FIG. 1). The first and second exhaust pipes 13*a* and 13*b* are coupled together on the outside of the sealed casing 2 and communicate with the aforementioned condenser.

A first discharge passage 14*a* is formed in the main bearing 6. The passage 14*a* is open to that end face 32 of the main bearing 6, which looks to the working chamber $10A_1$. The first discharge passage 14*a* extends from the end face 32 along the axis of the main bearing and is bent midway in the radial direction of the main bearing 6 to be open to the peripheral surface of a flange portion of the main bearing 6. The flange portion of the main bearing 6 is coupled to the sealed casing 2.

A second discharge passage 14*b* is formed in the sub-bearing 7. The passage 14*b* is open to that end face 3 of the sub-bearing 7, which looks to the working chamber $10B_1$. The second discharge passage 14*b* extends from the end face 33 along the axis of the sub-bearing 7 and is bent midway in the radial direction of the sub-bearing 7 to be open to the peripheral surface of a flange portion of the sub-bearing 7. The flange portion of the sub-bearing 7 is coupled to the sealed casing 2.

The end working chambers $10A_1$ and $10B_1$ of the working chambers 10A and 10B are made to communicate with the first and second exhaust pipes 13*a* and 13*b* via the first and second discharge passages 14*a* and 14*b* and the inside space of the sealed casing 2.

An oil reservoir 15 for receiving oil 34 is formed at the bottom of the sealed casing 2. A lower end portion of a suck-up pipe 16 is immersed in the oil 34 in the oil reservoir 15. The suck-up pipe 16 extends linearly towards the oil reservoir 15.

An upper end portion of the suck-up pipe 16 is inserted into the sub-bearing 7 and communicates with the piston support hole 7*a* of the sub-bearing 7. On the other hand, an oil supply hole 17 is formed in the piston 5. The oil supply hole 17 extends from an end face 35 of the sub-bearing 5*b* towards the main bearing 5*a* along the axis of the piston 5. An end portion of the oil supply hole 17 is open to the bottom of the first spiral groove 8*a*, and an intermediate portion of the hole 17 is open to the bottom of the second spiral groove 8*b*.

An oil supply passage 18 is constituted by the suck-up pipe 16, oil supply hole 17 and the space (i.e. part of the support hole 7*a*) between the suck-up pipe 16 and hole 17. The space between the suck-up pipe 16 and oil supply hole 17 is defined by that inner peripheral surface of the sub-bearing 7, which defines the support hole 7*a*, and the end face 35 of the sub-bearing 5*a*. The oil 34 is sucked up from the oil reservoir 15 by the compressing operation described later.

The rotary body 19 is fixed to the outer peripheral wall of the cylinder 4. A stator 20 is situated outside the rotor 19 with a gap therebetween. The stator 20 is fixed to the sealed casing 2. The rotor 19 and stator 20 constitute a motor unit 21.

A torque transmission mechanism (not shown) is provided within the cylinder 4. The torque transmission mechanism is attached at one end of the cylinder 4 and piston 5, and couples the piston 5 and cylinder 4. The torque transmission mechanism and motor unit 21 constitute a driving mechanism 22. The driving mechanism 22 rotates the cylinder 4 and piston 5 relative to each other and synchronously.

The rotation of the piston 5 is restricted by the torque transmission mechanism. The torque transmission mechanism comprises, for example, a combination of an engaging pin and an engaging groove.

When the motor unit 21 in the compressor 1*a* is actuated, the cylinder 4 is rotated. The cylinder 4 and piston 5 are rotated relative to each other and synchronously by the function of the torque transmission mechanism. Accordingly, a low-pressure refrigerant gas to be compressed is sucked in the suction passage 11 through the suction pipe 12.

The refrigerant gas is guided into the axially middle working chamber 10C of the cylinder 4, and it flows from the opening of the suction passage 11 into the working chambers 10A and 10B. Further, the refrigerant gas flows in two directions and is conveyed sequentially towards the end working chambers $10A_1$ and $10B_1$ of the cylinder 4 in accordance with the rotation of the piston 5.

Since the pitch of the working chambers 10A and 10B is decreased gradually towards the ends of the cylinder 4, the gas is compressed while it is conveyed. When the refrigerant gas reaches the first and second discharge passages 14*a* and 14*b*, the pressure of the refrigerant gas is raised to a predetermined value.

The refrigerant gas is once discharged from the first and second discharge passages 14*a* and 14*b* into the inside space of the sealed casing 2 and is then exhausted through the first and second exhaust pipes 13*a* and 13*b*. The gas exhausted from the first and second exhaust pipes 13*a* and 13*b* is supplied to the condenser.

Specifically, the cylinder 4 includes a first compression section A and a second compression section B. The refrigerant gas supplied from the suction passage 11 to the middle working chamber 10C is divided and compressed by the first and second compression sections A and B.

On the other hand, in accordance with the compression operation of the compressor sections A and B, the oil 34 in the oil reservoir 15 is sucked up by the suck-up pipe 16 and is guided to the first and second spiral grooves 8*a* and 8*b* through the oil supply passage 18. Substantially the same amount of oil 34 is supplied into each of the grooves 8*a* and 8*b* from the bottoms of the grooves 8*a* and 8*b*.

The oil 34 is supplied to sliding parts of the compression sections A and B, such as contact areas between the side walls of the first and second spiral grooves 8*a* and 8*b* and the side surfaces of the first and second blades 9*a* and 9*b*. A sufficient amount of oil 34 is supplied to the respective sliding parts, and smoothness of sliding parts is ensured for a long time.

Since the phases of the spiral grooves 8*a* and 8*b* are shifted from each other by 180°, the phases of sine curves of load torques and discharge pulses in both directions are also shifted by 180°. By virtue of the phase shift, the load torque and discharge pulse of the overall compressor can be decreased.

Strictly speaking, even if the paired spiral grooves 8*a* and 8*b* are formed in the piston 5, as in the above embodiment, the pressure acting on the piston 5 is, in some cases, not balanced. In such cases, a thrust force is exerted to the piston 5.

Owing to the influence of the thrust force, the end face of the piston 5 is brought into slidable contact with the end face of the main bearing 6 (or sub-bearing 7), and a frictional loss occurs in the mutually contacted end faces. Consequently, the input increases. It is therefore necessary to bring the piston 5 and bearings 6 and 7 into smooth contact with each other, taking the thrust force into account in advance.

Figure 3:
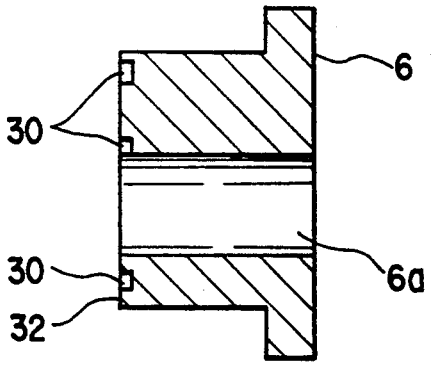
FIG. 3 is a vertical cross-sectional view of a main bearing.
Figure 4:
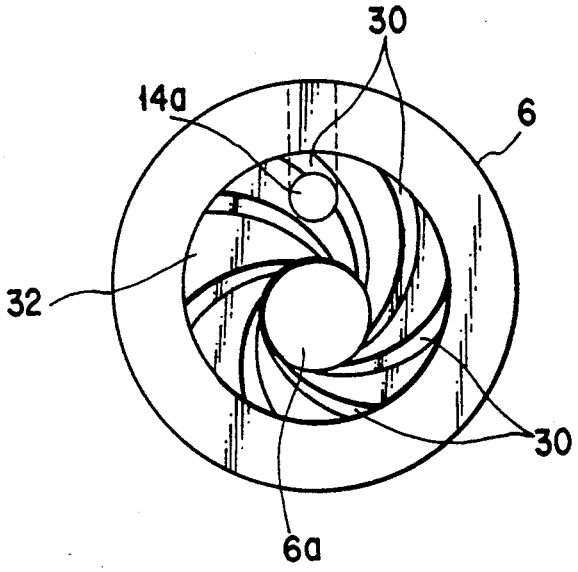
FIG. 4 is a side view showing an end face of the main bearing.
Figure 5:
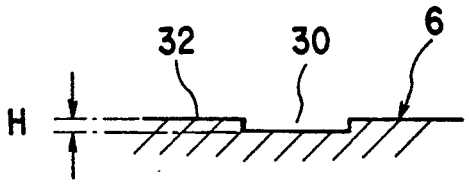
FIG. 5 is a view for illustrating the depth of an oil groove.

FIGS. 3 to 5 show effective means for solving this problem. Specifically, the end face 32 or thrust face of the main bearing 6 is provided with a plurality of spiral oil grooves 30 inclined radially.

The depth H of each groove 30 may be very small. Even if the depth H of the oil groove 30 is small, the oil 34 led to the sliding part becomes an oil layer, and the oil layer has a sufficient load capacity.

Since the oil grooves 30 have a spiral form as an entire body, the oil 34 on the end face 32 of the main bearing 6 is conveyed by the rotation of the piston 5 from the outer periphery side towards the center.

In other words, an oil layer is continuously formed on the end face 32 of the main bearing 6. Thus, even when the end face 31 of the main bearing 5*a* is put in slidable contact with the end face 32 of the main bearing 6 by the influence of the thrust, the oil layer formed constantly between the end faces 31 and 32 prevents frictional loss.

In the present embodiment, the main bearing 6 is adopted for describing the oil grooves 30; however, the oil grooves 30 may be formed on the sub-bearing, for example.

As has been described above, according to the fluid compressor 1*a* of the first embodiment, the oil supply passage 18 is formed, and it is branched midway. Thus, oil can be surely supplied to the two compression sections A and B in the respective sliding parts, and smoothness of the sliding parts can be ensured for a long time.

Figure 6:
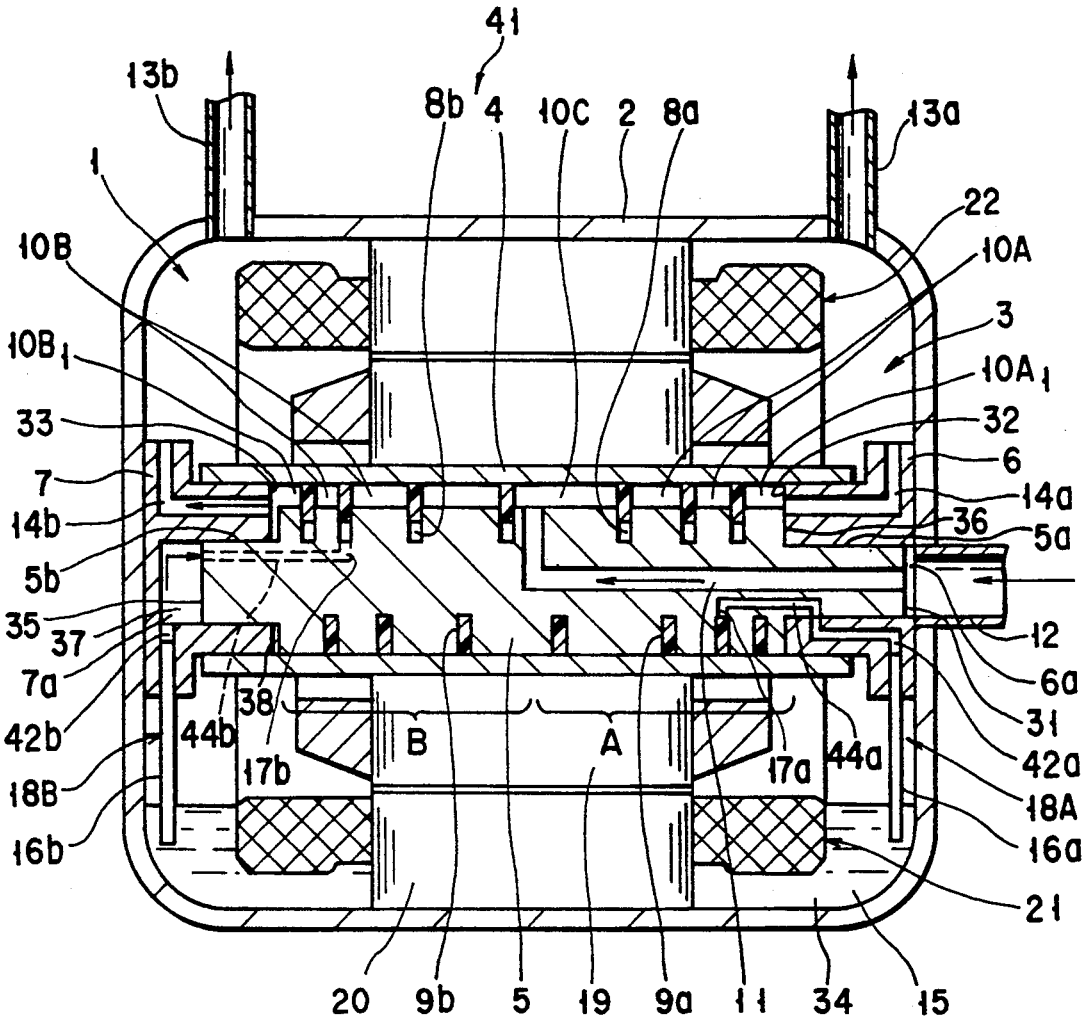
FIG. 6 is a vertical cross-sectional view showing a second embodiment of the invention.

In the first embodiment, the oil supply passage 18 is provided, and the oil 34 is sucked up only from the sub-bearing 7 situated at one end of the cylinder 4; however, the present invention is not limited to this embodiment, and a fluid compressor 41, as shown in FIG. 6, may be constituted.

FIG. 6 shows a second embodiment of the invention. The structural elements common to those in the first embodiment are denoted by like reference numerals and a description thereof is omitted.

In the fluid compressor 41 of the second embodiment, and suck-up pipes 16*a* and 16*b* are connected to the main bearing 6 and sub-bearing 7.

The suck-up pipe 16*a* is connected to the main bearing 6. The suck-up pipe 16*a* communicates with an oil guide hole 42*a* bent in the main bearing 6. The guide hole 42*a* is open to the inner peripheral surface of the main bearing 6.

Figure 7:
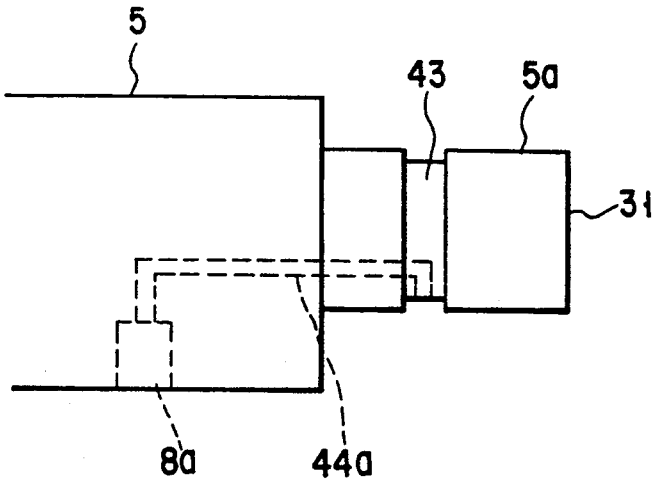
FIG. 7 is a view for illustrating a main bearing-side end portion of a rotary body according to the second embodiment.

As is shown in FIG. 7, a recess 43 for introducing oil is formed in the peripheral surface of the main shaft portion 5*a* of the piston 5. The recess 43 extends annularly along the circumference of the main bearing 5*a*. The opening of the oil guide hole 42*a* faces the recess 43.

One end portion of a first oil supply hole 44*a* is open to the recess 43. The first oil supply hole 44*a* extends in parallel to the axis of the piston 5, and it is bent midway in the radial direction of the piston 5 to be open to the bottom of the first spiral groove 8*a*. A first oil supply passage 18A is constituted by the suck-up pipe 16*a*, oil guide hole 42*a*, recess 43 and first oil supply hole 44*a*.

The suck-up pipe 16*b* is inserted in a second oil guide hole 42*b* of the sub-bearing 7. The suck-up pipe 16*b* communicates with the space of the support hole 7*a* and also with a second oil supply hole 44*b* formed in the piston 5. The second oil supply hole 44*b* extends along the axis of the piston 5, and it is bent midway in the radial direction of the piston 5 to be open to the bottom of the second spiral groove 8*b*. A second oil supply passage 18B is constituted by the suck-up pipe 16*b*, second oil guide hole 42*b*, support hole 7*a* and second oil supply hole 44*b*.

In this fluid compressor 41, the cylinder 4 and piston 5 are rotated relative to each other and synchronously. In accordance with the rotation of the cylinder 4 and piston 5, the oil 34 in the reservoir 15 is sucked up through the first oil supply passage 18A and second oil supply passage 18B, individually.

Substantially the same amount of oil 34 is led to the oil supply passages 18A and 18B. The oil 34 is caused to flow out through the bottoms of the first and second spiral grooves 8*a* and 8*b*; thus, the sliding parts of the compression sections A and B are directly supplied with oil.

Figure 8:
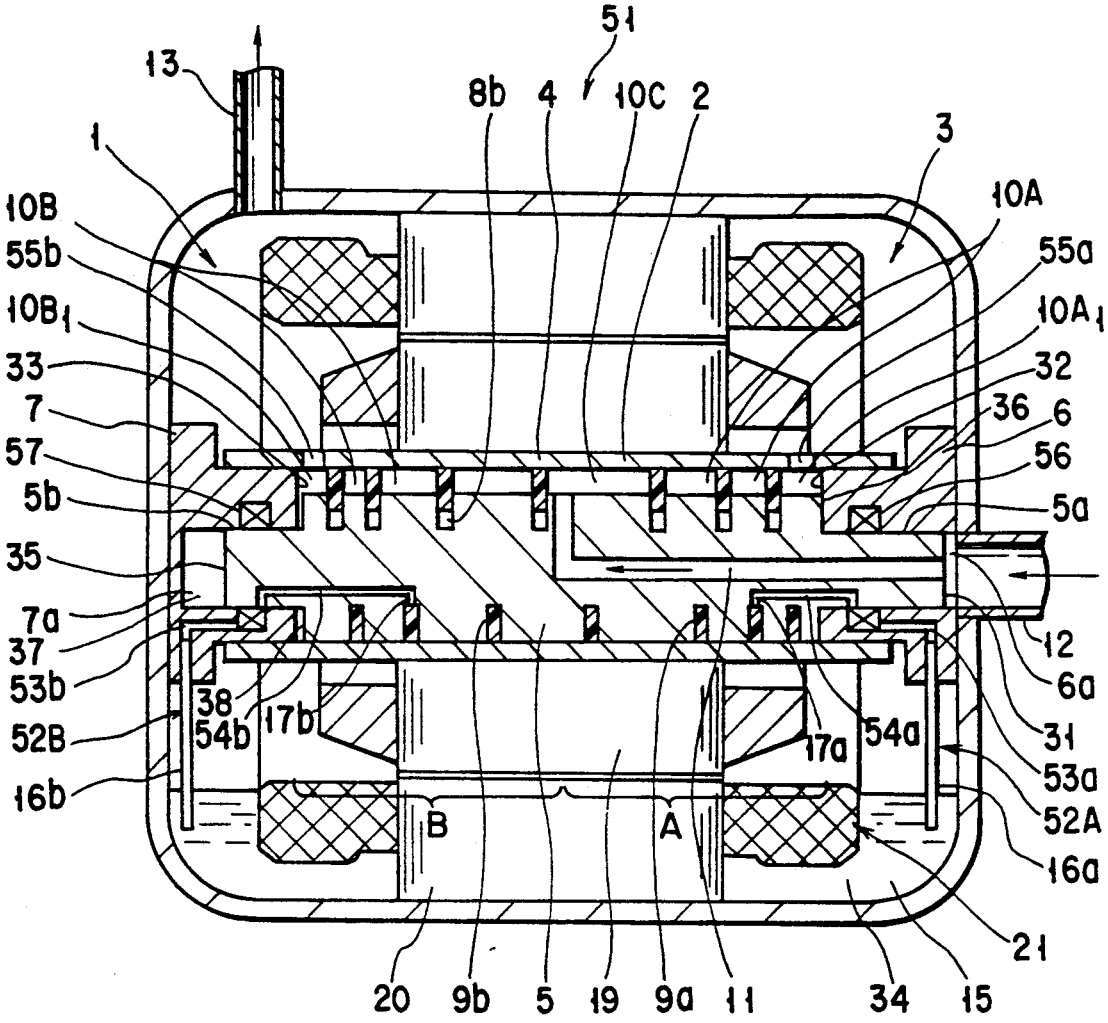
FIG. 8 is a vertical cross-sectional view showing a third embodiment of the invention.

FIG. 8 shows a third embodiment of the present invention. The structural elements common to those of the preceding embodiments are denoted by like reference numerals, and a description thereof is omitted.

In a fluid compressor 51 of the third embodiment, first and second oil supply passages 52A and 52B are formed to correspond to the first and second compression sections A and B. The first and second oil supply passages 52A and 52B are formed symmetrically on the main bearing (6)-side and on the sub-bearing (7)-side. In addition, the oil supply passages 52A and 52B have first and second oil guide holes 53*a* and 53*b*. Each oil supply passage 52A, 52B is constituted by suck-up pipe 16*a*, 16*b*, oil guide hole 53*a*, 53*b* and oil supply hole 54*a*, 54*b*.

The first and second oil supply holes 54*a* and 54*b* are formed in the piston 5, and extend along the axis of the piston 5. Both end portions of each of oil supply holes 54*a* and 54*b* are bent and extended in the radial direction of the piston 5. The end portions of the oil supply holes 54*a* and 54*b* are open to the outer peripheral surfaces of the shaft portions 5*a* and 5*b* and to the bottoms of the spiral grooves 8*a* and 8*b*.

First and second discharge holes 55*a* and 55*b* are open at both axial end portions of the cylinder 4. The discharge holes 55*a* and 55*b* communicate with end working chambers $10A_1$ and $10B_1$. In addition, one discharge pipe 13 is connected to the casing 2.

The refrigerant gas compressed and conveyed to the working chambers $10A_1$ and $10B_1$ are discharged into the inside of the casing 2 through the discharge holes 55*a* and 55*b* formed directly in the cylinder 4. The gas in the casing 2 is led to the outside of the casing 2 through the exhaust pipe 13.

The fluid compressor 51 further comprises first and second forced oil supply pumps 56 and 57. The pumps 56 and 57 are built in the main bearing 6 and sub-bearing 7. The pumps 56 and 57 are situated midway along the first and second oil supply passages 18A and 18B, that is, between the oil guide holes 53*a* and 53*b* and the oil supply holes 54*a* and 54*b*. The oil supply pumps 56 and 57 increase fluidity of oil flowing from the oil guide holes 53*a* and 53*b* to the oil supply holes 54*a* to 54*b*.

The forced oil supply pumps 56 and 57 suck up the oil 34 from the oil reservoir 15, and forcedly supply the oil 34 to the bottoms of the first and second spiral grooves 8*a* and 8*b*. According to this fluid compressor, oil supply is ensured with no influence due to pressure variation.

For example, when the compressor 51 is started, the pressure within the sealed casing 2 is low and accordingly the pressure acting on the oil 34 is low. In compressor 51, the oil 34 is fed to the compressor mechanism 3 by utilizing the pressure within the casing 2. Thus, when the pressure within the casing 2 is low, the fluidity of oil 34 is low. Therefore, when the oil supply pumps 56 and 57 are provided, the oil supply is ensured without influence due to pressure variation.

Figure 9:
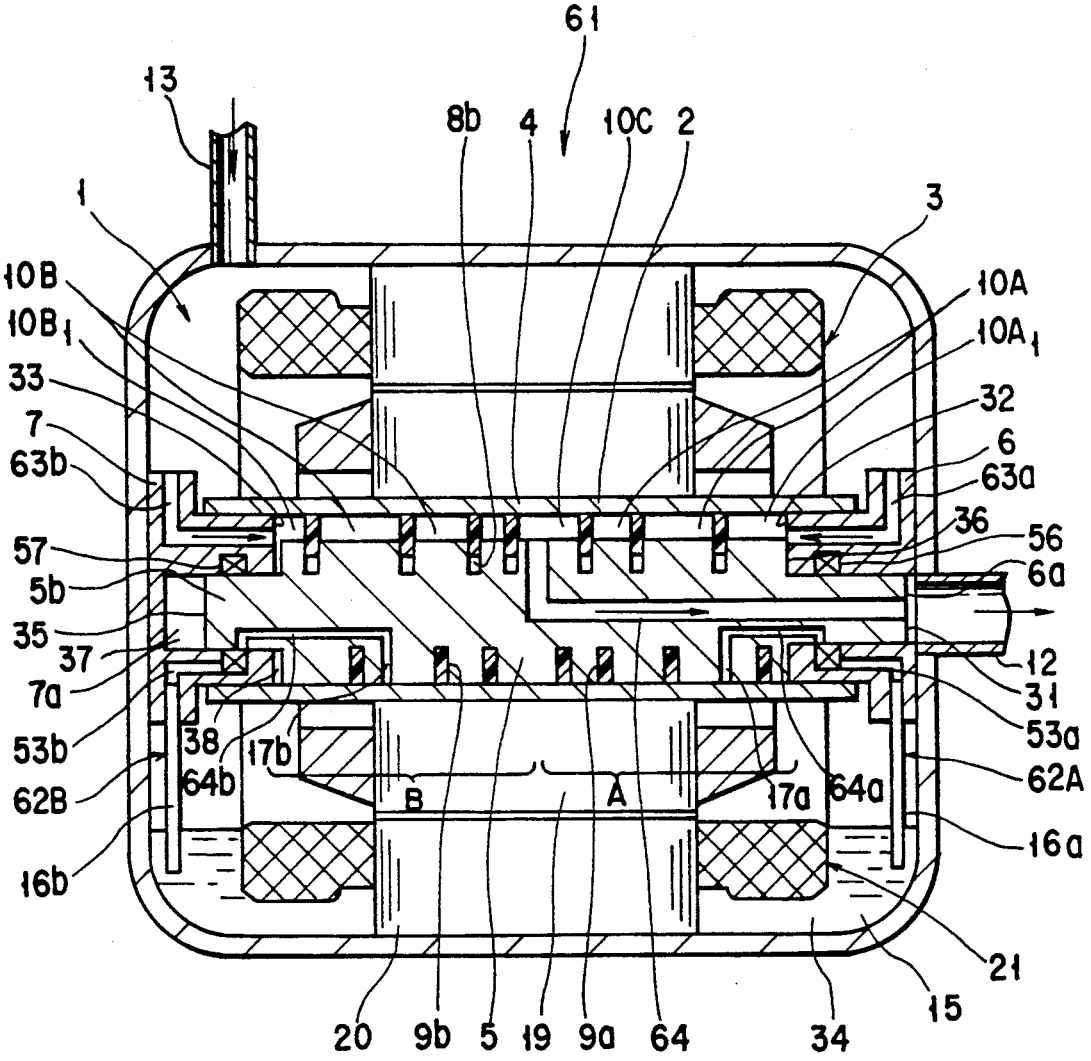
FIG. 9 is a vertical cross-sectional view showing a fourth embodiment of the invention.

FIG. 9 shows a fourth embodiment of the invention. The same structural elements as those in the preceding embodiments are denoted by like reference numerals, and a description thereof is omitted.

A fluid compressor 61 shown in FIG. 9 is a so-called low-pressure type compressor. This compressor is also provided with first and second oil supply passages 62A and 62B. In the compressor 61, the pitches of the first and second spiral grooves 8*a* and 8*b* are decreased from both ends of the piston 5 towards the middle part, contrary to the above-described compressors. Spiral blades 9*a* and 9*b* are fitted in the spiral grooves 8*a* and 8*b*.

First and second suction passages 63*a* and 63*b* are formed in the main bearing 6 and sub-bearing 7, and discharge passage 64 is formed in the piston 5. Refrigerant gas is sucked into end working chambers $10A_1$ and $10B_1$ of the piston 5 via the suction passages 63*a* and 63*b*. The gas is conveyed and compressed, and discharged from the middle part of the piston 5 via the discharge passage 64.

Accordingly, in the fluid compressor 61, the pressure at the middle of the piston 5 is high, and the pressure at both ends is low.

The first and second oil supply passages 62A and 62B are formed so as to correspond to the first and second compression sections A and B. The oil supply passages 62A and 62B are constituted by the suck-up pipes 16*a* and 16*b*, oil guide holes 53*a* and 53*b* and first and second oil supply holes 64*a* and 64*b*.

The first and second oil supply holes 64*a* and 64*b* are formed in the piston 5, and extend in parallel to the axis of the piston 5. Both end portions of each of oil supply holes 64*a* and 64*b* are bent in the radial direction of the piston 5, and are open to the outer peripheral surfaces of the shaft portions 5*a* and 5*b* and piston 5.

The compressor further comprises forced oil supply pumps 56 and 57. The pumps 56 and 57 are situated at the boundaries between the oil guide holes 53*a* and 53*b* and the oil supply holes 64*a* and 64*b*. The pumps 56 and 57 suck up the oil 34 from the oil reservoir 15 forcedly into the first and second oil supply passages 62A and 62B. The oil 34 introduced into the first and second oil passages 62A and 62B flow out from the outer periphery of the piston 5. The oil 34 is directly supplied to the working chambers 10 against the pressure of refrigerant gas, without passing through the spiral grooves 8*a* and 8*b*.

Since the fluid compressor 61 has the forced oil supply pumps 56 and 57, the oil 34 can be surely supplied to the compression sections A and B, irrespective of the conveying direction of refrigerant gas.

In FIG. 9, the oil 34 communicates with the contact parts between the cylinder 4 and piston 5, and it flows to the contact parts from the outer peripheral surface of the piston 5. The oil 34 leaks from the contact parts between the cylinder 4 and piston 5 and spreads into the cylinder 4. Thus, the oil 34 is supplied to the sliding parts. The contact parts function to prevent excess oil supply.

The fluid compressor of the present invention is applicable not only to the refrigerating cycle, but also to other types of compressors for compressing fluids.

What is claimed is:

1. A fluid compressor comprising:

a closed casing having an oil reservoir for containing oil;

a cylinder situated within the casing;

a cylindrical rotary body situated eccentrically within the cylinder and supported with part thereof brought into contact with an inner peripheral surface of the cylinder, said rotary body having, in its outer peripheral surface, first and second spiral grooves of decreasing pitch extending in opposite directions from a middle part of the rotary body to both ends of the rotary body;

first and second spiral blades fitted in the first and second spiral grooves, said blades having outer peripheral surfaces brought into contact with the inner peripheral surface of the cylinder, dividing a space defined by the inner peripheral surface of the cylinder and the rotary body into a plurality of working chambers, thereby constituting first and second compression sections, wherein said first and second blades freely project from and retreat in the first and second spiral grooves in the radial direction of the rotary body;

driving means for rotating the cylinder and the rotary body relative to each other;

a first refrigerant passage formed in the rotary body and opening to an area between the first and second compression sections and to one axial end portion of the rotary body;

oil supply means for supplying oil pressurized in an inner space of the closed casing to the first and second compression sections;

a main bearing for supporting one axial end portion of the cylinder and one axial end portion of the rotary body;

a sub-bearing for supporting the other axial end portion of the cylinder and the other axial end portion of the rotary body, said sub-bearing having a support hole to which an end portion of the rotary body is inserted;

a first refrigerant pipe communicating with said first refrigerant passage;

at least one second refrigerant pipe opening to the inside space of the casing; and at least one second refrigerant passage causing the first and second compression sections to communicate with the inside space of the casing, wherein said oil supply means includes a single oil supply passage having an oil supply hole, said oil supply hole extends in the rotary body parallel to the axis of the rotary body and communicates with an oil supply space defined by said support hole, a suck-up pipe for sucking up the oil and guiding the oil to the support hole is connected to the sub-bearing, said oil supply means further including said suck-up pipe and said oil supply space.

2. The fluid compressor according to claim 1, wherein oil grooves are spirally formed at at least one of an area between the end face of the main bearing and an end face of the rotary body and an area between the end face of the sub-bearing and an end face of the rotary body.

3. The fluid compressor according to claim 1, wherein pitches of both spiral grooves and both spiral blades are gradually decreased from the middle part of the rotary body towards end portions of the rotary body, said first refrigerant passage is a suction passage, said second refrigerant passage is a discharge passage, said first refrigerant pipe is a suction pipe, and said second refrigerant pipe is an exhaust pipe.

4. The fluid compressor according to claim 1, wherein the phases of both blades are shifted from each other by 180°.

* * * * *